US008171947B2

(12) United States Patent
Hardie

(10) Patent No.: US 8,171,947 B2
(45) Date of Patent: May 8, 2012

(54) AUTOMOBILE COVER APPARATUS

(75) Inventor: Leslie Glenn Hardie, Calabasas, CA (US)

(73) Assignee: Leslie Glenn Hardie, Calabasas, CA (US)

( * ) Notice: Subject to any disclaimer, the term of this patent is extended or adjusted under 35 U.S.C. 154(b) by 0 days.

(21) Appl. No.: 12/862,077

(22) Filed: Aug. 24, 2010

(65) Prior Publication Data

US 2012/0048320 A1 Mar. 1, 2012

(51) Int. Cl.
*E04H 15/38* (2006.01)

(52) U.S. Cl. ..... 135/129

(58) Field of Classification Search ..... 35/124, 35/128, 129, 136, 137, 906; 135/124, 128, 135/129, 136, 137, 906
See application file for complete search history.

(56) References Cited

U.S. PATENT DOCUMENTS 2,698,629 A * 1/1955 Hall ..... 135/124
2,817,344 A * 12/1957 Teeter ..... 135/129
2,824,764 A * 2/1958 Stirling ..... 296/105
3,231,305 A * 1/1966 Beckman ..... 296/100.12
3,248,830 A * 5/1966 Maynard ..... 52/67
3,845,591 A * 11/1974 Stine ..... 52/67
4,285,539 A * 8/1981 Cole ..... 296/105
4,756,325 A * 7/1988 Daniels ..... 135/88.09
4,886,083 A 12/1989 Gamache
5,201,152 A * 4/1993 Heffner ..... 52/64
5,546,972 A * 8/1996 Wardell et al. ..... 135/129
6,257,260 B1 * 7/2001 Phillips ..... 135/88.13
7,128,356 B2 * 10/2006 Bassett ..... 296/37.6
2008/0210284 A1 * 9/2008 Dubois ..... 135/129
2010/0200035 A1 * 8/2010 Jordache et al. ..... 135/96

* cited by examiner

*Primary Examiner* — Noah Chandler Hawk
(74) *Attorney, Agent, or Firm* — Dariush G. Adli; Adli Law Group

(57) ABSTRACT

A car cover apparatus which has a frame, a plurality of ribs moveably attached to the frame, and a cover attached to the plurality of ribs. Movement of the ribs allow the car cover to be opened and closed. When the ribs are pulled apart, the cover is expanded to cover an automobile. When the ribs are compressed, the user can access the automobile parked within the car cover. According to certain embodiments of the invention, the car cover can be motor-driven and operated by remote control.

18 Claims, 6 Drawing Sheets

AUTOMOBILE COVER APPARATUS

FIELD OF THE INVENTION

The subject matter described herein relates to an automobile cover. More specifically, it relates to a free-standing automobile cover apparatus that can be motor-driven.

BACKGROUND

The concept of using a cover to protect an automobile's exterior surface is well-known. As such, numerous inventions have been conceived that embody the basic theme of covering an automobile with a protective material to protect it from environmental forces (e.g., wind, rain, snow, solar radiation), other objects, other adjacent automobiles, etc.

In its most basic form, an automobile cover can be formed from a single piece of fabric that is draped over the top of the automobile. This type of conventional automobile cover may further include various cords, belts, ties, etc., all in an effort to maintain the placement of the automobile cover while in use. Numerous other devices have been added to these conventional automobile covers in an effort to improve their functionality and/or the aesthetic appearance.

Nevertheless, conventional automobile covers, as well as most non-conventional automobile covers, suffer from many drawbacks. For example, many automobile covers are comprised of nothing more than a fabric bag. As such, they touch and thereby scratch the automobile's paint while in use. Fabric covers are also difficult to use and can require substantial physical effort to deploy. In many instances, the covers must be stretched over the automobile by hand. Accordingly, two or more people are often needed to effectively cover and uncover an automobile using a conventional automobile cover. Furthermore, the physical process of installing an automobile cover can be dirty. This is especially true when covering or uncovering an automobile cover that fits over dirty wheels and under bumpers. As many automobile cover users can undoubtedly attest, any physical contact with the automobile cover during the process of covering or uncovering the automobile can potentially ruin the user's clothing. Even further, covering and uncovering an automobile cover can take a substantial amount of time. In today's busy world where every second counts, the disadvantages of this are readily apparent. As yet another example, most conventional automobile covers do not allow ingress or egress from the automobile when the automobile cover is deployed. This may be desirable to quickly access an item in the automobile without removing the automobile cover in its entirety. Finally, some automobile covers require modification of the automobile's trunk or bumper to be effective. For example, some automobile covers require attachments to be installed inside or on the vehicle, such as bolts, rods, hooks, and straps to be effective for its intended purpose. But not all automobile users are willing to physically alter or affect their vehicles just so a certain automobile cover can be used.

With all that being said, there exists a unfulfilled need for an improved automobile cover that addresses the various disadvantages inherent to automobile covers found in the prior art.

SUMMARY

According to the embodiments of the present invention, a free-standing automobile cover apparatus is provided that is capable of being motor-driven by a remote control.

In the preferred embodiment of the invention, the automobile cover apparatus includes a material cover (e.g., a fabric cover) that is supported by a plurality of free-standing ribs, the ribs being movably attached to side rails, wherein the side rails are incorporated into a frame that rests on the ground. Through the use of the plurality of free-standing ribs and side rails, the material cover can be adapted to form a chamber within which an automobile can be parked. The front of the automobile cover apparatus is closed off from the outside environment, while the back of the automobile cover apparatus can be opened to allow ingress and egress of an automobile.

The preferred embodiment of the invention includes two basic configurations. The first configuration is the deployed configuration (as shown in FIG. 1). In this configuration, the ribs are fully extended to completely cover the automobile that is parked therein. The second configuration is the undeployed configuration (as shown in FIG. 2) wherein the ribs are compressed against each other. In this configuration, the user can easily enter or exit the automobile that is parked within the automobile cover.

The preferred embodiment of the invention also includes a mechanical means for moving the ribs (and thereby the cover) between the deployed and undeployed configurations. For example, the movement of plurality of ribs can be accomplished by using motor-driven linear screw rod actuators. In other words, motor-driven screw rods can be used that have a threaded exterior surface that mates with a threaded portion of one or more of the plurality of ribs. Thus, rotation of the screw rods will cause the plurality of ribs to move as well. Furthermore, the motor can be operated by a remote control. This can be similar to the remote controlled use of a standard garage door that is opened and closed through the use of a motor.

The free-standing automobile cover apparatus, summarized above, and described in much greater detail below, is quick and easy to use and eliminates the need for the user to physically touch the automobile cover to enter or exit the automobile. It is also designed to shelter, but not touch the automobile parked inside of it, which prevents the automobile from being inadvertently scratched by the automobile cover itself. These and other benefits of the present invention will be readily apparent from figures and detailed description of the invention provided herein.

BRIEF DESCRIPTION OF THE DRAWINGS

The accompanying drawings, which are incorporated into and constitute a part of this specification, illustrate one or more embodiments, and together with the detailed description, serve to explain the principles and implementations of the invention. In the drawings.

DETAILED DESCRIPTION

Embodiments are described herein in the context of a free-standing automobile cover apparatus. Those of ordinary skill in the art will realize that the following detailed description is illustrative only and is not intended to be in any way limiting. Other embodiments of the present invention will readily suggest themselves to such skilled persons having the benefit of this disclosure. Reference will now be made in detail to implementations of embodiments of the present invention as illustrated in the accompanying drawings. The same reference indicators will be used throughout the drawings and the following detailed description to refer to the same or like parts.

General Assembly of the Automobile Cover Apparatus

Figure 1:
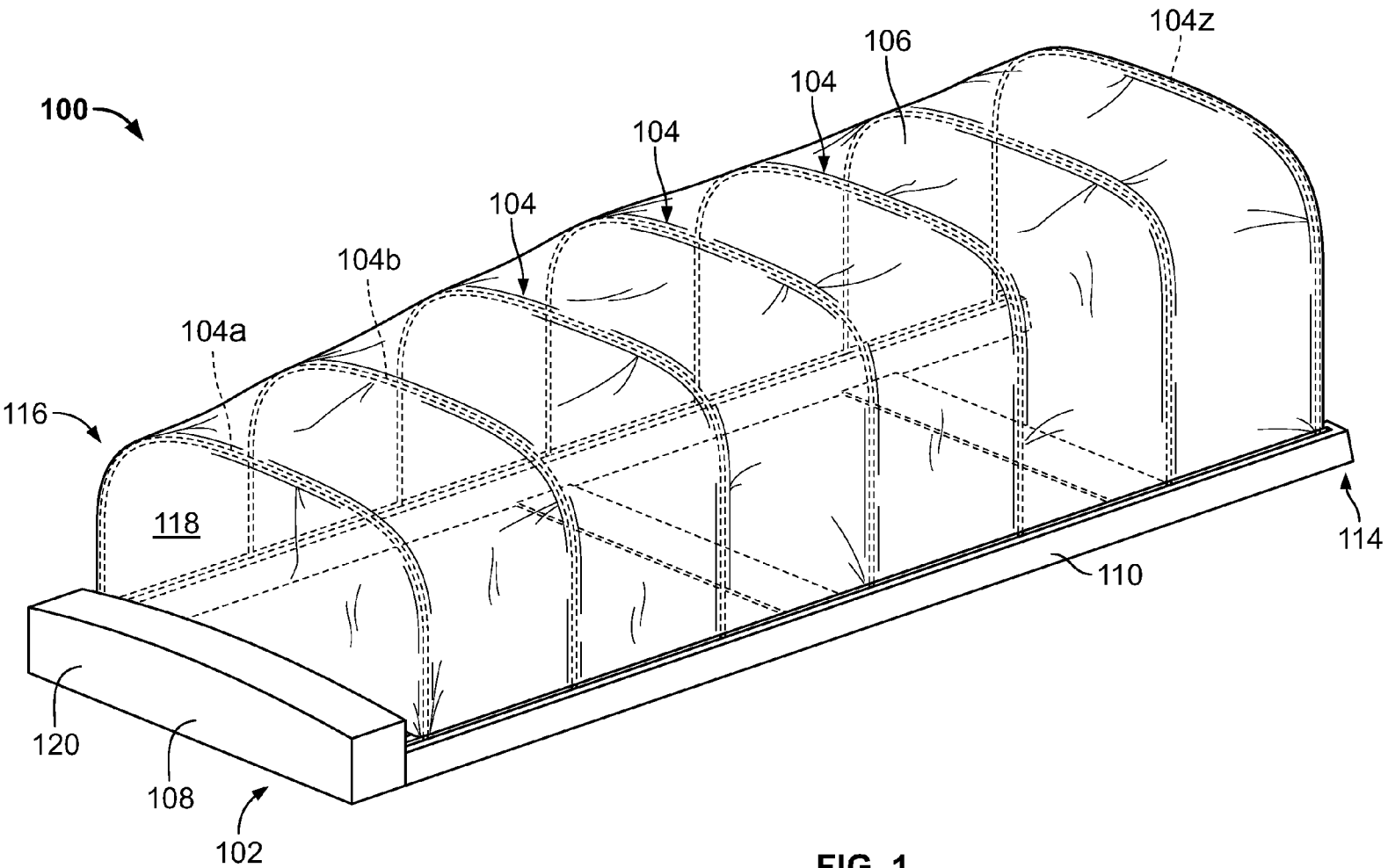
FIG. 1 illustrates a top perspective view of an automobile cover apparatus in its deployed configuration in accordance with an embodiment of the present invention.
Figure 2:
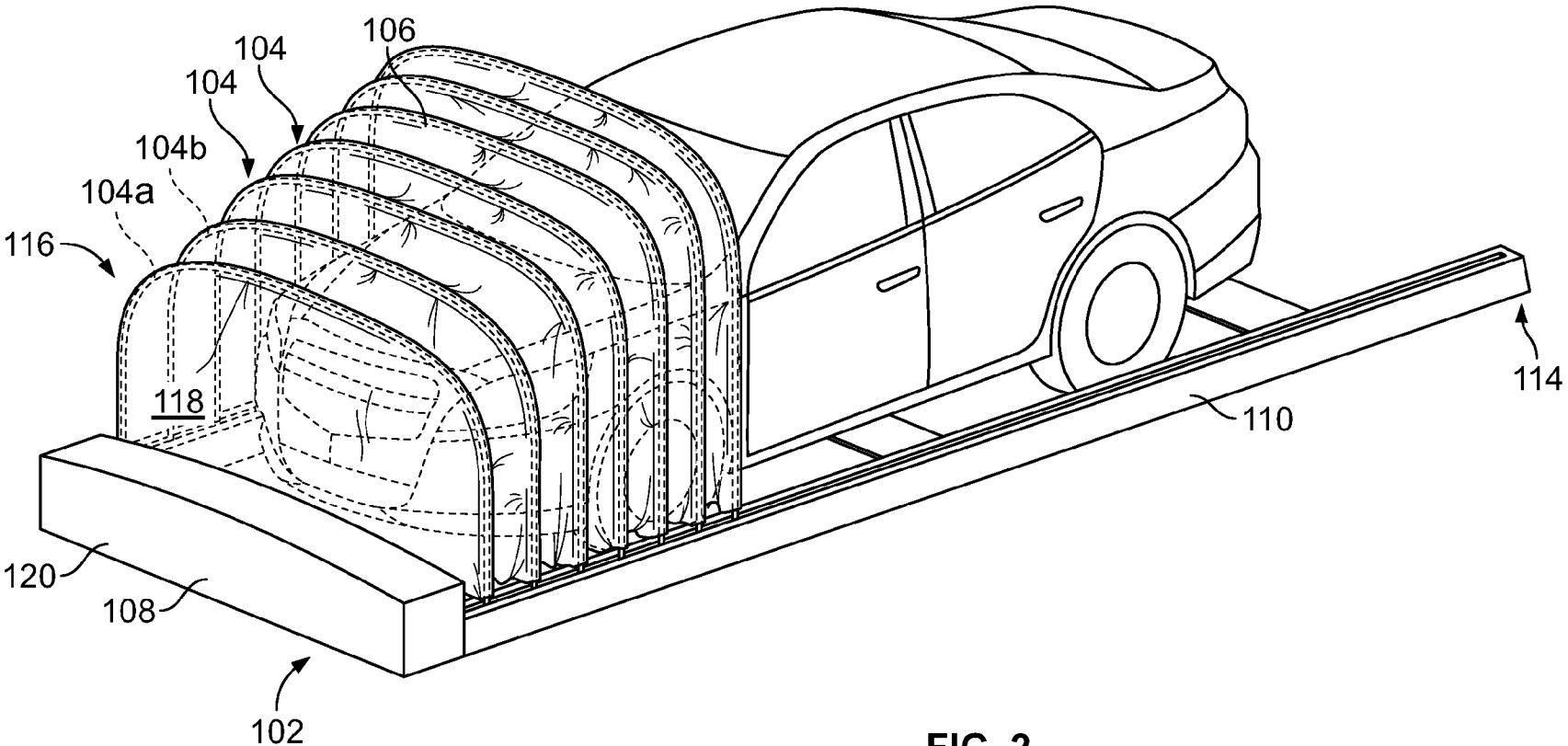
FIG. 2 illustrates a top perspective view of an automobile cover apparatus in its undeployed configuration in accordance with an embodiment of the present invention.

FIGS. 1 and 2 illustrate perspective views of an embodiment of automobile cover apparatus 100. Specifically, FIG. 1 illustrates a top perspective view of an embodiment of automobile cover apparatus 100 in its deployed configuration, while FIG. 2 illustrates a top perspective view of the same embodiment of automobile cover apparatus 100 in its undeployed configuration.

Referring now to FIG. 1, automobile cover apparatus 100 can be seen as including frame 102, a plurality of ribs 104, and cover 106. Frame 102 can further be seen as including front beam 108 and side rails 110,112 (side rail 112 can be seen in FIG. 3). The relationship between these parts of automobile cover apparatus 100 can be described as follows.

Figure 3:
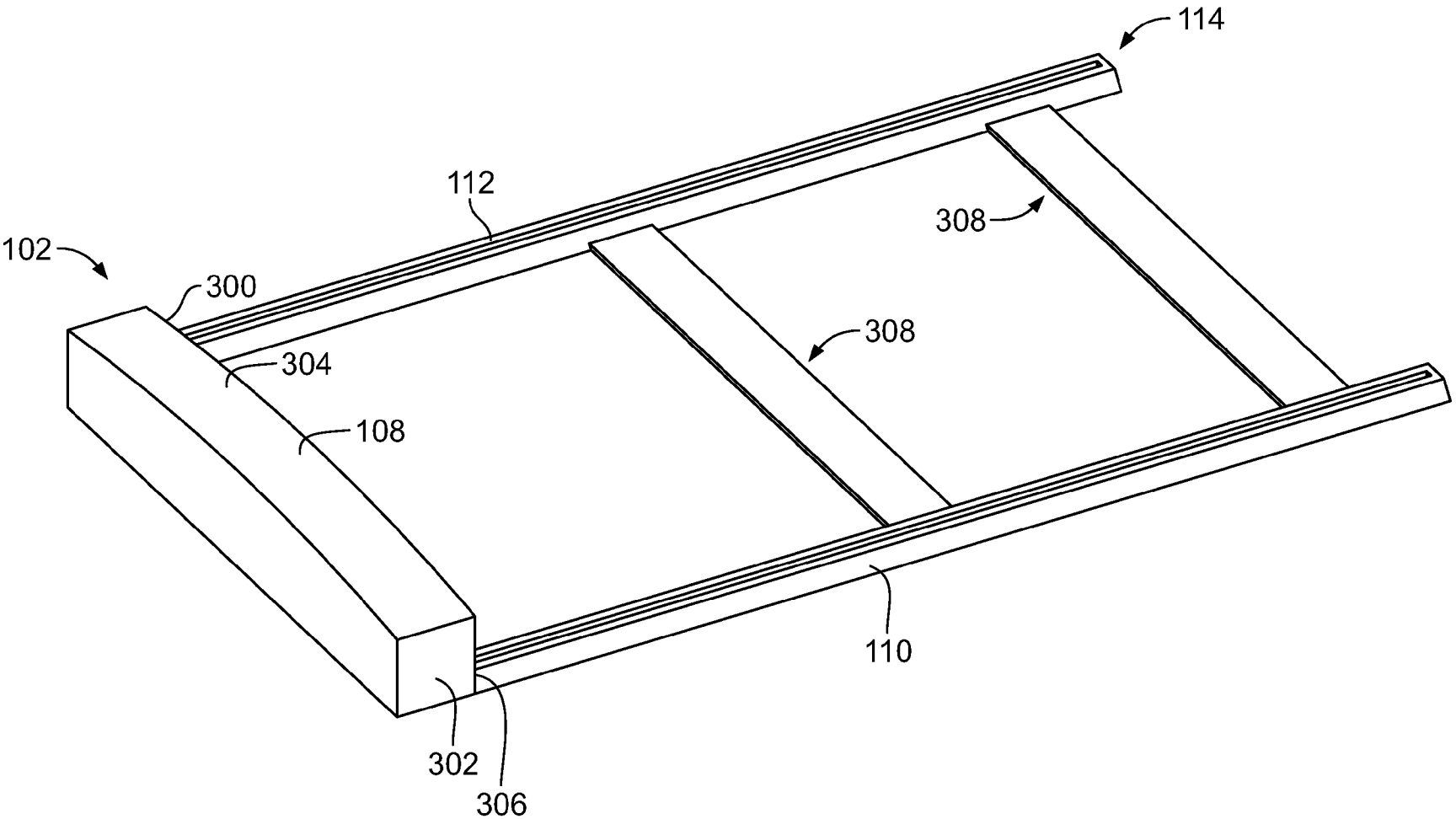
FIG. 3 illustrates a top perspective view of an embodiment of a frame for an automobile cover apparatus in accordance with an embodiment of the present invention.

Referring briefly to FIG. 3, an embodiment of frame 102 for automobile cover apparatus 100 is illustrated as including front beam 108 attached to side rails 110 and 112. Specifically, the ends 300, 302 of front beam 108 can be seen as being attached to ends 304, 306 of side rails 110, 112. Consequently, frame 102, in its fully assembled state, has a U-shape as it rests on the ground. In an embodiment, frame 102 may also include one or more intermediate plates 308 attached to both side rails 110, 112 to provide dimensional stability to frame 102. In other words, these plates 308, along with front beam 108, maintain rails 110, 112 in a parallel configuration.

The front beam 108 and side rails 110, 112 can have any length as desired by the user, and can be designed to accommodate any vehicle having any size. For example, to accommodate most standard sized vehicles, the side rails may be designed to be approximately 16-17 feet long and approximately 4-5 inches high, while front beam 108 is 7-8 feet long and approximately 4-5 inches high. The rails can of course be longer or shorter, as well as shorter or taller, if the user/manufacturer seeks to design automobile cover apparatus 100 for a specific vehicle. In an embodiment, front beam 108 and side rails 110, 112 will be made of a solid metal (e.g., steel).

Referring back to FIG. 1, the fully assembled frame 102 can be seen as being attached to a plurality of ribs 104. In this embodiment, each of the plurality of ribs 104 are generally U-shaped, wherein the ends of the U-shaped plurality of ribs 104 are attached to side rails 110, 112 perpendicular to frame 102. In the preferred embodiment, at least two or more of the plurality of ribs 104 are movably attached to side rails 110, 112 of frame 102, wherein the plurality of ribs 104 are positioned parallel to one another. In an exemplary embodiment, automobile cover apparatus 100 includes approximately 8-10 ribs 104. Nonetheless, other embodiments may easily have more or less ribs and still fall within the scope of the invention.

In certain embodiments of the invention, the height of the plurality of ribs 104 can be uniform or can be varied. For example, in an embodiment, the plurality of ribs 104 may all have a uniform height of approximately 4-5 feet to accommodate a car having an average height. The height can be increased for larger automobiles (e.g., trucks), or decreased for smaller automobiles (e.g., motorcycles). In the embodiment illustrated in FIGS. 1 and 2, the plurality of ribs 104 have a progressively shorter profile as they get closer to front beam 108.

As shown in FIG. 1, cover 106 is attached to the plurality of ribs 104. In an embodiment, cover 106 can be attached to the plurality of ribs 104 at equidistant intervals. By attaching cover 106 to each of the plurality of ribs 104, any movement of the plurality of ribs 104 will alter the area enclosed by cover 106. In an embodiment, cover 106 may be permanently attached to the plurality of ribs 104. For example, the plurality of ribs 104 can be sewn into cover 106. In another embodiment, the plurality of ribs 104 may be detachably connected to the plurality or ribs 104. For example, a series of loops can be sewn into cover 106 at regular intervals, whereby the plurality of ribs 104 can be secured to cover 106 within those loops.

In the preferred embodiment, cover 106 is made of a flexible, light-weight, weather-resistant, waterproof fabric. Materials used for cover 106 may include cotton, polyester taffeta, nylon, etc. In certain embodiments, these materials can include a polyurethane coating. Other embodiments of cover 106 may include waterproof/breathable laminates. Cover 106, however, can be made of any other appropriate material, and have any appropriate coating, as envisioned by those having ordinary skill in the art and still fall within the scope of this invention.

In an embodiment, rib 104*a*, which is the rib that is positioned proximal to the front end 116 of automobile cover apparatus 100 (i.e., adjacent to front beam 108 of frame 102), is immovably attached to frame 102. In this embodiment, rib 104*a* further includes front cover 118, which forms the front face of automobile cover apparatus 100. In this manner, automobile cover apparatus 100 includes a consistent front end that is permanently closed off from the outside environment.

In an embodiment, back end 114 of automobile cover apparatus 100 is always open to the outside environment. In another embodiment, the back end 114 of automobile cover apparatus 100 can be closed off from the outside environment through the use of a vertical back cover flap (not illustrated), which is attached to rib 104*z*. This back cover flap can easily be opened and closed by the user during use. In an embodiment, the back cover flap can be held in place next to cover 106 and/or the plurality of ribs 104 through the use of various attachments devices including, but not limited to, Velcro, buttons, a zipper, etc.

General Operation of the Automobile Cover Apparatus

Referring again to FIG. 1, automobile cover apparatus 100 is illustrated here in its deployed configuration. In this embodiment, automobile cover apparatus 100 is deployed by extending the plurality of ribs 104 away from each other until rib 104z is positioned proximal to the back end 114 of automobile cover apparatus 100. This configuration pulls cover 106 attached to the plurality of ribs 104 tight, pulling the adjacent cover 106 segments along, so that the entire cover 106 is stretched to its maximum length. This operation is similar to that of a bellows and allows cover 106 to fully expand to provide a canopy under which an automobile can be parked within automobile cover apparatus 100. In this manner, in the deployed configuration, cover 106 substantially shelters the area between side rails 110, 112.

Referring now to FIG. 2, automobile cover apparatus 100 is illustrated here in its undeployed configuration. In this configuration, the plurality of ribs 104 have been compressed against each other so that rib 104z is now closer to front end 116 of automobile cover apparatus 100 than back end 114 of automobile cover apparatus 100. By arranging the plurality of ribs 104 closer to one another, cover 106 automatically becomes compressed between the plurality of ribs 104, which allows the user to easily access the automobile that is parked within automobile cover apparatus 100.

Rib and Rail Embodiments

Figure 4:
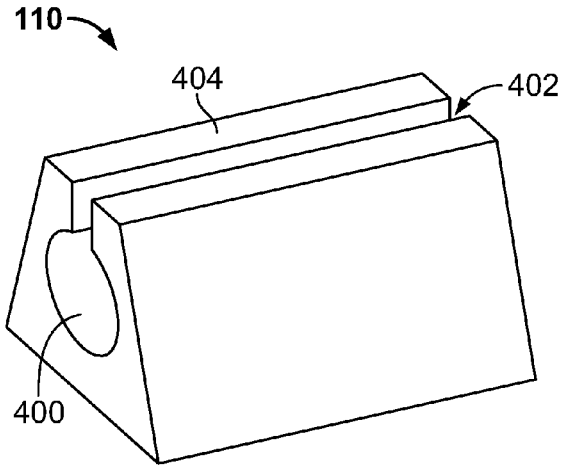
FIG. 4 illustrates a section of a side rail for an automobile cover apparatus in accordance with an embodiment of the present invention.
Figure 5:
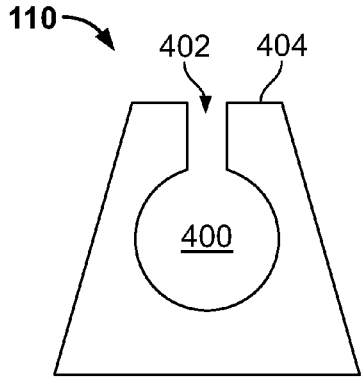
FIG. 5 illustrates a front-sectional view of a side rail for an automobile cover apparatus in accordance with an embodiment of the present invention.

Referring now to FIG. 4, a section of an embodiment of rail 110 is illustrated. In this embodiment, rail 110 can be seen as being generally pyramid-shaped with a flattened top. But it is to be understood that rail 110 may have any other shape (e.g., rectangular) and still fall within the scope of the invention. In this embodiment, rail 110 can also be seen as including central channel 400, wherein central channel 400 runs the entire length of rail 110. Rail 110 further includes slot 402, wherein slot 402 extends longitudinally from the top 404 of rail 110 to central channel 400. Slot 402 also runs the entire length of rail 100. In this embodiment, the diameter of central channel 400 is larger than the width of slot 402 on the top 404 of rail 110. Accordingly, when looking at rail 110 from a front cross-sectional view (as shown in FIG. 5), central channel 400 and slot 402 generally form an upside down light bulb-shaped void in the middle of rail 110.

Figure 6:
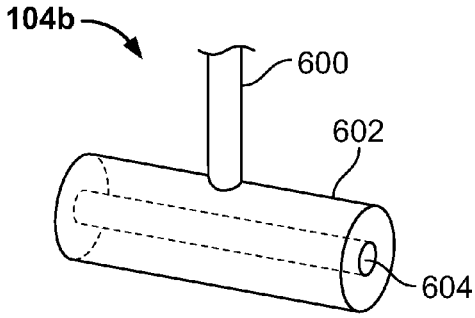
FIG. 6 illustrates a section of a slider for a rib for an automobile cover apparatus in accordance with an embodiment of the present invention.

Referring now to FIG. 6, a section of rib 104b is illustrated. In this embodiment, rib 104b can be seen as including shaft 600, which is attached to slider 602. Shaft 600 is the portion of the plurality of ribs 104 that is illustrated in FIGS. 1 and 2. Accordingly, in an embodiment, the entire shaft 600 can be a solid U-shaped cylindrical rod that extends from rail 110 to rail 112. In an embodiment, shaft 600 is made of a solid and rigid material (e.g., aluminum).

Slider 602 is attached to shaft 600 at both ends of rib 104b. Slider 602 can be attached to shaft 600 using any method that would be contemplated by one having ordinary skill in the art. For example, in an embodiment, shaft 600 can be screwed into a threaded hole incorporated into slider 602. In this embodiment, slider 602 has a cylindrical shape. It is to be understood, however, that slider 602 may have any other shape (e.g., spherical) and still fall within the scope of the invention. In the embodiment illustrated in FIG. 6, slider 600 includes a central bore 604, the purpose of which will be explained below.

Figure 7:
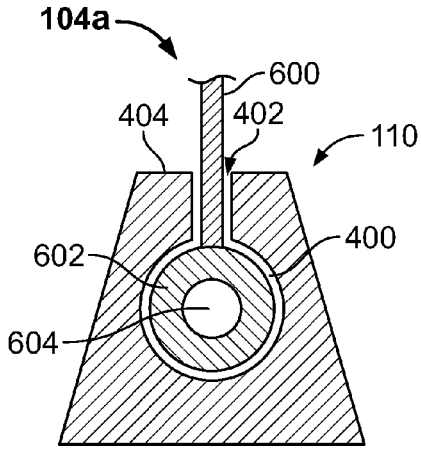
FIG. 7 illustrates a front-sectional view of a slider within a slide rail in accordance with an embodiment of the present invention.

Referring now to FIG. 7, an embodiment of the method of slidably securing rib 104b to rail 110 becomes readily apparent. Specifically, slider 602 of rib 104b can be placed within central channel 400 of rail 110. Shaft 600, which extends away from slider 602, is allowed to extend out of rail 110 through slot 402 at the top 404 of rail 110. Since slider 602 includes a larger diameter than the width of slot 402 at the top 404 of rail 110, rib 104b will remain safely secured to rail 110 even when rib 104a is slid back and forth as automobile cover 100 is being used.

Since the plurality of ribs 104 can be movably connected to rails 110, 112 through the connection means illustrated in FIG. 7, the plurality of ribs 104 can slide back and forth as a part of automobile cover 100. As described above, sliding the plurality of ribs 104 towards front end 116 of automobile cover apparatus 100 will compress cover 106, thereby exposing the automobile that is parked within automobile cover apparatus 100. Conversely, sliding the plurality of ribs 104 towards the back end 114 of frame 102 will stretch cover 106 to provide a canopy for the automobile that is parked within automobile cover apparatus 100.

Mechanical Operation of the Automobile Cover

One desirable method of operating automobile cover apparatus 100 is to eliminate the need for the user to physically touch any portion of automobile cover apparatus 100 during the operation of the apparatus. Accordingly, in an embodiment of the invention, automobile cover apparatus 100 is equipped with a small electric motor to allow for mechanical operation of automobile cover apparatus 100. The preferred embodiment for mechanically operating automobile cover apparatus 100 is provided below.

Figure 8:
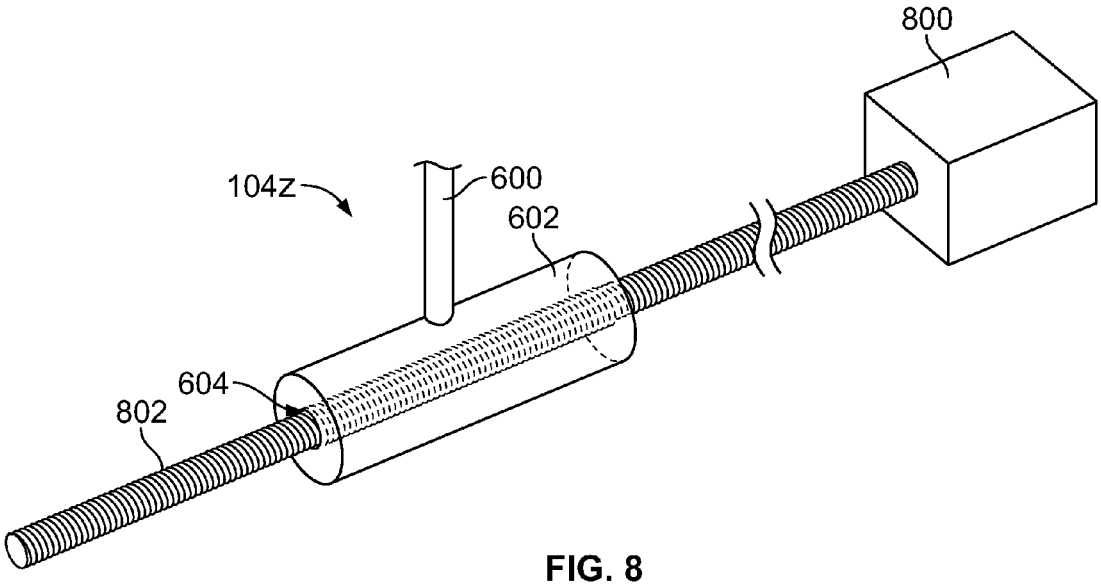
FIG. 8 illustrates a conceptual representation of a motor-driven automobile cover apparatus in accordance with an embodiment of the present invention.
Figure 9:
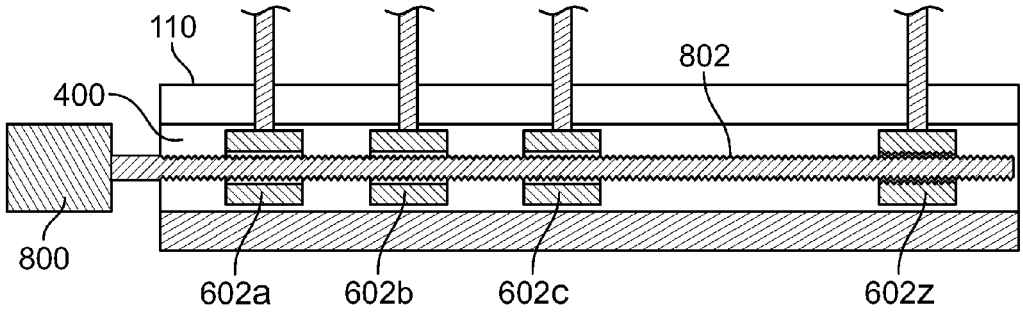
FIG. 9 illustrates a conceptual representation of a motor-driven automobile cover apparatus in accordance with an embodiment of the present invention.
Figure 10:
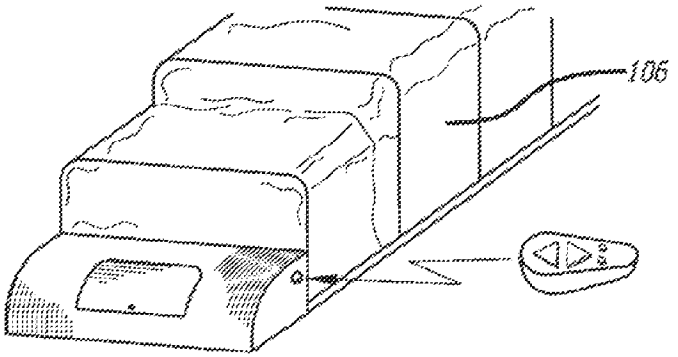
FIG. 10 illustrates a remote control and a remote sensing eye that can be used to turn on and off the motor.
Figure 11:
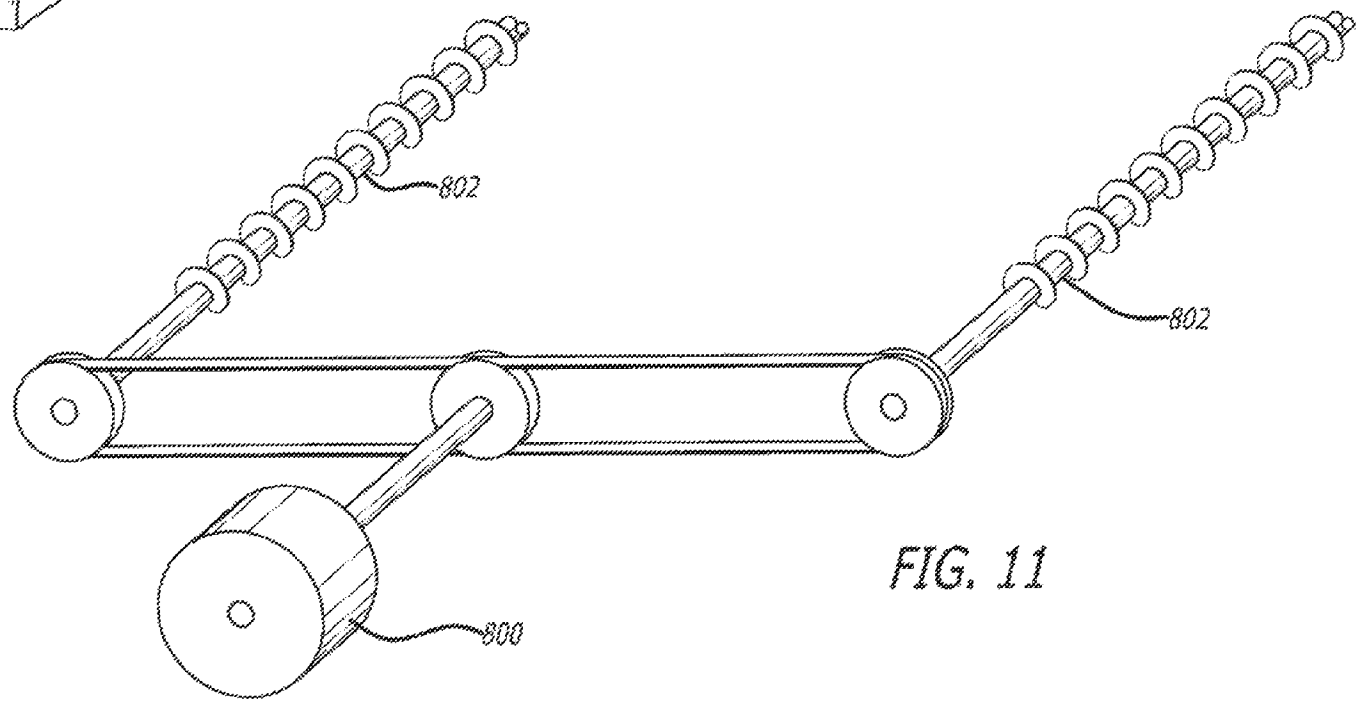
FIG. 11 illustrates a motor using a belt and pulley system to turn two screws.

FIGS. 8 and 9 provide conceptual illustrations of a motorized embodiment of the present invention utilizing a linear screw rod actuator. Referring first to FIG. 8, this conceptual illustration shows motor 800 as being attached to drive screw 802, wherein motor 800 can be used to rotate drive screw 802. As a part of automobile cover apparatus 100, drive screw 802 can be positioned within the central channel 400 of rail 110 (as shown in FIGS. 4 and 5), and runs the entire length of rail 110 (or rail 112). In this embodiment, drive screw 802 also extends through central bore 604 of slider 602, wherein drive screw 802 includes a threaded exterior surface that can be mated with a threaded interior surface of slider 602. In this manner, rotating drive screw 802 about its central axis will cause slider 602 to move back and forth consistent with the direction that drive screw 802 is being rotated.

Other embodiments of linear screw rod actuators can also be employed. Some examples of standard linear screw rod actuators that could be incorporated into automobile cover apparatus 100 can be found online at www.tolomatic.com and www.rotan.com.

Electric motor 800 can be powered by any means as envisioned by one having ordinary skill in the art. For example, electric motor 800 may be powered by a 110 volt power cord to a house plug, a 12 volt reducer, or a small 12 volt battery.

In the preferred embodiment, electric motor 800 can be operated by a remote control. In this embodiment, electric motor 800 could be operated in the same manner as a standard garage door opener is typically operated.

Referring now to FIG. 9, this conceptual depiction of an embodiment of automobile cover apparatus 100 illustrates four separate sliders 602a, 602b, 602c, and 602z that are connected to rail 110. In this embodiment, threaded drive screw 802 passes through central bores that have been incorporated into sliders 602a, 602b, 602c, and 602z within rail 110. As was the case above, motor 800 will cause drive screw 802 to rotate about its central axis.

When looking carefully at sliders 602a, 602b, 602c, and 602d, it can be seen that only slider 602d includes a threaded interior surface that mates with the treaded surface of drive screw 802. Accordingly, rotation of drive screw 802 will only directly control the movement of slider 602*d*. In this manner, slider 602*d* can be controlled independent from the other sliders 602*a*, 602*b* and 602*c*. In this embodiment, sliders 602*a*, 602*b* and 602*c* are allowed to freely slide back and forth along drive screw 802.

Overall, pulling slider 602*d* back will cause the other sliders to slide back, while pushing slider 602*d* forward pull cover 106, which is attached to sliders 602*a*, 602*b*, 602*c*, and 602*d*, which will in turn cause the other sliders to move forward. Consequently, the plurality of ribs 104 can easily be moved back and forth within automobile cover 100 by simply controlling slider 602*d* through the use of drive screw 802, which is powered by motor 800.

Again, FIGS. 8 and 9 are intended to provide conceptual illustrations of a motor-driven embodiment of the invention. Accordingly, in an embodiment, motor 800 will not be positioned directly behind drive screw 802, but rather will be positioned in its own separate housing unit 120 (as shown in FIGS. 1 and 2) adjacent to front beam 108 of frame 102. In an embodiment, motor 800 is centrally positioned between rails 110 and 112, and is used to drive the rotation of drive screws 802 positioned within rails 110 and 112 through the use of a belt and pulley system. It is to be understood, however, that the invention is not intended to be limited to any particular mechanical system for rotating the drive screws. Accordingly, any mechanical system for rotating the drive screws may be employed by automobile cover apparatus 100 and still fall within the scope of the invention.

In another embodiment of the invention, instead of using a motor, automobile cover apparatus 100 would be equipped with a hand-operated crank that would be capable of rotating the drive screws in order to move the plurality of ribs.

In yet other embodiments, the sliders used with this invention can have any other shape as envisioned by one having ordinary skill in the art. For example, in an embodiment, the intermediate sliders will not have a cylindrical shape with a central bore. Rather, the sliders can be flat plates that slide above the drive screws used within automobile cover apparatus 100. Any other design can be used as long as the intermediate sliders are free to be pulled and pushed along the length of automobile cover apparatus 100.

Portable Automobile Cover Apparatus

The embodiments of automobile cover apparatus 100 described above have generally been described according to a semi-permanent embodiment of the invention. In other words, once the user decides where to place automobile cover apparatus 100, it remains at that place during daily use. Nevertheless, another embodiment of the invention may include a portable version of automobile cover apparatus 100.

In this portable embodiment, all of the parts would be detachable from one another. For example, the plurality of ribs 104 could be detachable from cover 106 and frame 102. Side rails 110, 112 could be detached from front beam 108. Side rails 110, 112 and front beam 108 could include hinged joints that would allow them to be folded up into smaller sections. In this manner, all of the individual parts of automobile cover apparatus 100 could be gathered up and transported from one location to another. Once the user reaches the new location, the individual parts could be reassembled for further use.

The foregoing description of preferred embodiments of the present invention has been provided for the purposes of illustration and description. It is not intended to be exhaustive or to limit the invention to the precise forms disclosed. Many embodiments were chosen and described in order to best explain the principles of the invention and its practical application, thereby enabling others skilled in the art to understand the invention for various embodiments and with various modification that are suited to the particular use contemplated. It is intended that the scope of the invention be defined by the claims and their equivalents.

The invention claimed is:

1. A car cover apparatus, comprising:

a frame having side rails;

a plurality of ribs having at least a front end rib and a back end rib, wherein the plurality of ribs are attached to the side rails, wherein the front end rib is immobile and the back end rib is movably attached to the side rails;

a flexible cover, wherein the cover is attached to each of the plurality of ribs so that the cover extends from the front end rib to the back end rib; and wherein movement of at least the back end rib along the length of the side rails causes the cover to more between a deployed configuration and an undeployed configuration;

wherein each rib that moves from an undeployed position pulls the adjacent rib by stretching the cover;

wherein the apparatus is of a size suitable to cover an automobile in a deployed position, wherein the side rails each comprise a central channel;

wherein the ends of the plurality of ribs includes sliders, wherein the sliders are positioned within the central channels of the side rails;

wherein the sliders each comprise a central bore, wherein threaded drive screws are positioned within the bores of the sliders within the central channels of the side rails;

wherein the sliders attached to the back end rib have threaded central bores that mate with the threaded drive screws; and wherein rotation of the threaded drive screws controls the movement of the back end rib.

2. The car cover apparatus of claim 1, further comprising a motor, wherein the motor drives the movement of the back end rib.

3. The car cover apparatus of claim 2, wherein the motor is controlled by a remote control.

4. The car cover apparatus of claim 2, wherein the motor drives a belt and pulley system.

5. The car cover apparatus of claim 2, wherein the motor is encased in its own housing unit.

6. The car cover apparatus of claim 1, wherein the frame comprises a front beam, wherein one end of each of the side rails are attached to ends of the front beam.

7. The car cover apparatus of claim 1, wherein each of the plurality of ribs are arranged parallel to one another.

8. The car cover apparatus of claim 1, wherein each of the plurality of ribs are vertically attached perpendicular to the side rails.

9. The car cover apparatus of claim 1, further comprising at least one central rib, wherein the central rib slides freely along the side rails.

10. The car cover apparatus of claim 1, wherein only the end rib is moved to cause the cover to move between the deployed configuration and the undeployed configuration.

11. The car cover apparatus of claim 1, wherein the plurality of ribs are U -shaped.

12. The car cover apparatus of claim 1, wherein the car cover apparatus is portable.

13. The car cover apparatus of claim 1, wherein the plurality of ribs includes at least five individual ribs.

14. The car cover apparatus of claim 1, wherein the sliders have a cylindrical shape.

15. The car cover apparatus of claim 1, further comprising a motor, wherein the motor drives the rotation of the threaded drive screws.

16. The car cover apparatus of claim 1, wherein the cover is made from fabric.

17. The car cover apparatus of claim 1, wherein the apparatus has only one rail on each side.

18. A motor-driven car cover apparatus, comprising: a frame having side rails, wherein the side rails each comprises a central channel; a plurality of ribs having at least a front end rib, a central rib, and a back end rib, wherein the plurality of ribs are attached to the side rails, wherein the front end rib is immobile, the central rib slides freely along the side rails, and the back end rib is movably attached to the side rails, wherein the ends of the plurality of ribs includes sliders, wherein the sliders are positioned within the central channels of the side rails, wherein the sliders each comprise a central bore; a flexible cover, wherein the cover is attached to each of the plurality of ribs so that the cover extends from the front end rib to the back end rib; threaded drive screws, wherein the threaded drive screws are positioned within the bores of the sliders within the central channels of the side rails, wherein the sliders attached to the back end rib have threaded central bores that mate with the threaded drive screws, wherein rotation of the threaded drive screws controls the movement of the back end rib; and a motor, wherein the motor drives the rotation of the threaded drive screws, wherein the motor is remote-controlled, wherein movement of only the back end rib causes the cover to move between a deployed configuration and an undeployed configuration, wherein each rib that moves from an undeployed position pulls the adjacent rib by stretching the cover.

* * * * *